United States Patent [19]

Pitchford

[11] Patent Number: 4,696,640

[45] Date of Patent: Sep. 29, 1987

[54] FORTUNE CANDLE

[76] Inventor: Thomas E. Pitchford, Box 21, Napolean, N. Dak. 58561

[21] Appl. No.: 841,151

[22] Filed: Mar. 19, 1986

[51] Int. Cl.[4] ..... F23D 3/16

[52] U.S. Cl. ..... 431/289

[58] Field of Search ..... 431/126, 288, 289, 291

[56] References Cited

U.S. PATENT DOCUMENTS

| | | | |
|---|---|---|---|
| 1,636,709 | 7/1927 | Schmidt . | |
| 1,657,391 | 1/1928 | Haney . | |
| 1,831,902 | 11/1931 | Brown | 431/288 |
| 3,286,492 | 11/1966 | Frazier | 431/291 |
| 3,403,106 | 9/1968 | Story et al. | 252/92 |
| 3,413,230 | 11/1968 | Dupuis | 252/92 |
| 4,081,394 | 3/1978 | Bartley | 252/91 |
| 4,311,604 | 1/1982 | Hörnig | 252/90 |

*Primary Examiner*—Carroll B. Dority, Jr.
*Attorney, Agent, or Firm*—Kinney & Lange

[57] ABSTRACT

A candle made in a usual manner contains a fireproof, leak proof container, has a personalized message therein. The message may be a fortune, words of endearment, or perhaps a game token, and/or a coupon redeemable for a prize or for "cents off" a product. The prize container is initially hidden from the viewer. The candle is consumed until such time as the container or token is revealed. Alternatively, the candle can have a strip extending along the longitudinal axis and the strip is gradually exposed as the candle burns. Additional portions of a message on the strip will thus be readable as the candle burns.

1 Claim, 5 Drawing Figures

FORTUNE CANDLE

BACKGROUND OF THE INVENTION

1. Field of the Invention

The present invention relates to consumable members that expose an article as they are consumed.

2. Description of the Prior Art

Soap bars that have messages in them which are exposed as the soap bar is consumed are known. Typical devices are shown in U.S. Pat. No. 4,081,394 and U.S. Pat. No. 3,413,230. A buoyant soap bar that has an internal capsule inside a passageway is shown in U.S. Pat. No. 3,403,106 and an advertising material on the interior of a soap bar is shown in U.S. Pat. No. 1,636,709.

U.S. Pat. No. 4,311,604 shows a soap bar having a cavity stamped with a raised design or character, and U.S. Pat. No. 1,657,391 shows a soap cake that has an overwrap over a message that is laid on top of the soap bar.

A more romantic atmosphere is associated with candles, and the present device permits one to have an article, which may carry a message, contained in or on such article. The article is made available or exposed as the candle is consumed.

SUMMARY OF THE INVENTION

The present invention relates to a candle that has an article or object on the interior thereof which is not visible when the candle is initially used, but as the candle is consumed the object or article, either a token or some type of a container for a message will become exposed and available to the user.

The use of a candle conveying such a message permits one to utilize the romantic feelings that a candle generates psychologically, for conveying appropriate messages of a personal nature to others in a mystical and romantic way.

The invention comprises a candle of suitable size that has an article on the interior that is exposed as the candle is consumed. Preferably, the article is a container and most preferrably it is a foil packet that is fireproof and leak proof, and which contains a horoscope, message, or some other token (even advertising redeemable for a prize or cents off future purchases). The article is available as the candle melts.

Alternate designs provide a non-burnable token on the interior of the candle, and in one form of the invention a message strip which is not affected by the flame or hot wax, but which is exposed as the candle consumes, so that the message on the strip is revealed as the candle burns down. The message could include a plurality of short versus or couplets, or a complete message that was not completed until the candle was consumed or until the time that the strip could be removed from the candle.

DETAILED DESCRIPTION OF THE PREFERRED EMBODIMENTS

Figure 1:
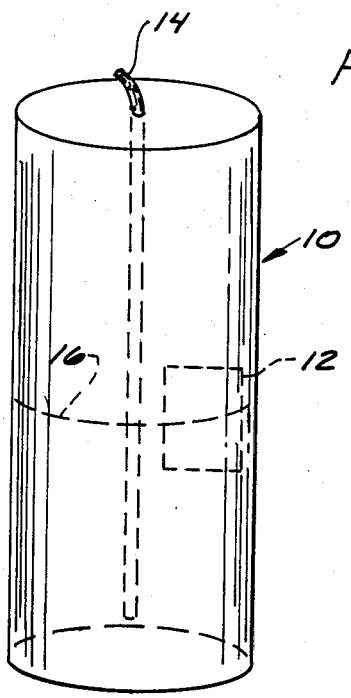
FIG. 1 is a perspective side view of a typical candle made according to the present invention.
Figure 2:
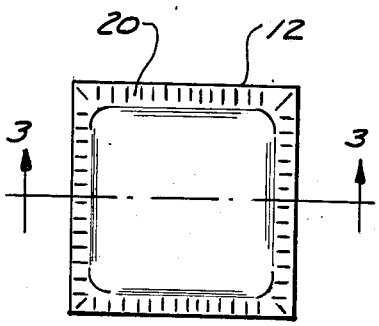
FIG. 2 is a plan view of an article comprising a message packet that is on the interior of the candle of FIG. 1.
Figure 3:
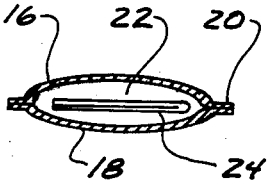
FIG. 3 is a sectional view of the packet taken on line 3—3 in FIG. 2.

In FIG. 1, a candle indicated generally at 10 has an article 12 embedded therein on the interior of the wax. The candle has a wick 14, and of course is constructed of consumable wax so that as the wick burns, the wax will be consumed. When the candle reaches a level substantially as shown at the dotted line at 16, the article 12 which comprises a message containing foil packet, will be exposed and can be removed. As shown in FIGS. 2 and 3, the packet in its preferred form is a rectangular shaped foil packet 12 having first and second layers of foil 16 and 18, respectively, that are sealed together in a known manner as at 20 around the periphery of the packet. The layers define an interior chamber 22 in which a small piece of message parchment or paper indicated at 24 can be placed with a suitable message. The message can be of a romantic nature, or a fortune statement such as that contained in a fortune cookie, or horoscopes may be provided.

In this manner mystery and romance can enter into the transferring of messages.

The candle 10 can be made of a relatively small size, and a person's horoscope for each day of a month can be placed into the packets 12 in a series of thirty candles, or in other words a month long supply of candles, so that during each day the person would burn one of the candles and receive a horoscope message or a message of good fortune.

The candles can also be made for special occasions, such as birthdays, anniversaries, valentine's day and other holidays. A unique way of conveying a message in a manner that evokes good feeling (generally candle flames are cheerful) is provided. The mystery and suspense is that the message is unknown until such time as the packet or token 12 is uncovered.

Figure 4:
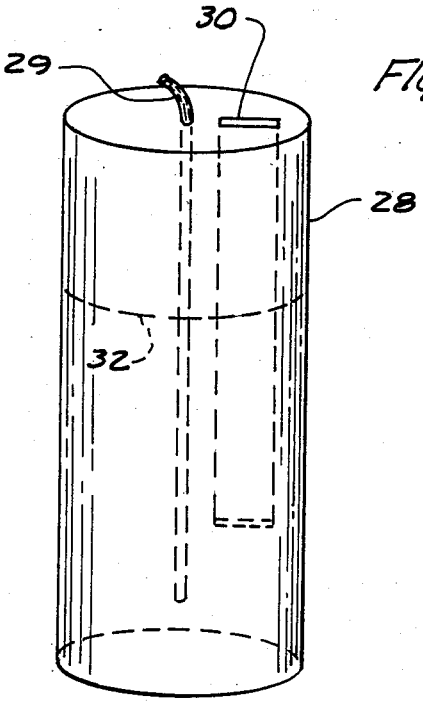
FIG. 4 is a perspective view of a candle having a second form of the message carrying an article therein.
Figure 5:
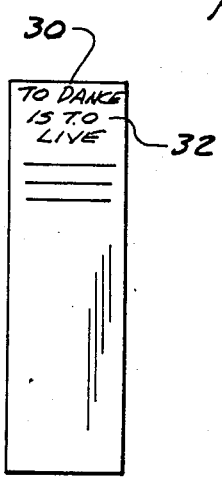
FIG. 5 is a plan view of the message carrying an article in the candle of FIG. 4.

A modified form of the invention is shown in FIGS. 4 and 5, and in this form a candle 28 has a wick 29 therein. The candle is made of wax in the normal manner. The wick extends for the full length of the candle so that the candle can be consumed.

An elongated article comprising a message strip indicated at 30 is embedded in the candle. The strip may be exposed at the top edge as shown in FIG. 4, with the rest of the strip below the upper surface of the candle and hidden from view. As the candle burns down, for example to a dotted line level shown generally at 32, a message will be exposed. The message strip 30 is shown in FIG. 5, and can have lines of message such as that indicated at 32 that will be exposed slowly as the candle is burned.

The strip 30 can be made of aluminum foil or other material that would be unaffected by the melted wax or by heat or flame. It should be non-burnable of course as well and the writing has to be such that it would not be affected by heat.

In either form of the invention shown, the contained article is exposed as the candle is consumed, and is primarily designed for messages. The preferred form is with a packet so that the messages can be easily formed and placed into the candles prior to molding.

Additionally if desired, game tokens can be used, which may have advertising material on them could be placed into the candle directly, with no overwrap. Also, coupons for redemption of value can be placed into packets 12. The use are limited only by the imagination of the user.

The article such as the packet 12 or the strip 30 containing the message can be placed into the candle mold when the candle is formed. The article is spaced inwardly from the outer surfaces of the candle and spaced upwardly from the bottom of the candle so that the message will be available before the candle is discarded.

Although the present invention has been described with reference to preferred embodiments, workers skilled in the art will recognize that changes may be made in form and detail without departing from the spirit and scope of the invention.

What is claimed is:

1. A candle having a hidden presealed surprise message therein, comprising a candle having a wick, and a top and bottom, said candle having an outer periphery, a sealed packet having an interior chamber, said sealed packet being made of non-flamable material that protects the interior from heat of the candle and being manually openable, said packet being completely enclosed within the candle periphery at a location spaced upwardly from the bottom of the candle initially and positioned to be exposed as the candle is consumed, and a message containing sheet separate from the packet, contained in the interior chamber of the packet.

* * * * *

UNITED STATES PATENT AND TRADEMARK OFFICE

CERTIFICATE OF CORRECTION

PATENT NO. : 4,696,640

DATED : September 29, 1987

INVENTOR(S) : Thomas E. Pitchford

It is certified that error appears in the above-identified patent and that said Letters Patent is hereby corrected as shown below:

Column 4, line 9, after "interior", insert --chamber--.

Signed and Sealed this

Twenty-sixth Day of January, 1988

*Attest:*

DONALD J. QUIGG

*Attesting Officer*

*Commissioner of Patents and Trademarks*